US005301759A

United States Patent [19]

Ruhle

[11] Patent Number: 5,301,759

[45] Date of Patent: Apr. 12, 1994

[54] METHOD AND APPARATUS FOR CORE-SAMPLING SUBSURFACE ROCK FORMATIONS

[76] Inventor: James L. Ruhle, 2535 E. Balfour Ave., Fullerton, Calif. 92631

[21] Appl. No.: 844,455

[22] Filed: Mar. 2, 1992

[51] Int. Cl.[5] ..... E21B 49/02

[52] U.S. Cl. ..... 175/58; 175/246

[58] Field of Search ..... 175/58, 245-248, 175/294, 310, 394, 403, 404

[56] References Cited

U.S. PATENT DOCUMENTS

| | | | |
|---|---|---|---|
| 2,331,553 | 10/1943 | Hoffoss et al. | 175/248 |
| 2,738,167 | 3/1956 | Williams, Jr. | 175/246 |
| 3,127,943 | 4/1964 | Mori | 175/246 |
| 3,346,059 | 10/1967 | Sevendsen | 175/246 |
| 4,081,040 | 3/1978 | Henson | 175/246 |
| 4,466,497 | 8/1984 | Soinski et al. | 175/246 |
| 4,518,051 | 5/1985 | Sollie et al. | 175/58 |
| 4,629,011 | 12/1986 | Reinhardt | 175/58 |
| 4,735,269 | 4/1988 | Park et al. | 175/58 |

*Primary Examiner*—Ramon S. Britts
*Assistant Examiner*—Frank S. Tsay

[57] ABSTRACT

An electrically-driven downhole coring method and apparatus which is powered by and conveyed to and from the bottom of the corehole by means of a heavy-duty electromechanical cable. The downhole core-sampling apparatus is equipped with a combination reamer, stabilizer, and external-reforcing component which also functions as an external axial-thrust weight, drilling-fluid circulation pump, and helical inertial-displacement elevator or excavated rock particles. During the high-speed rotation of the core-sampling apparatus by the downhole electric motor, drilling fluid with its load of excavated rock particles is displaced upward from the bottom of the corehole into the interior of a combination centrifuge/storage-chamber component where the excavated rock particles are separated from the lower-density drilling fluid and the clarified drilling fluid is circulated downward along a decreasing pressure gradient to the core bit, thus completing its circulation loop. When the downhole apparatus is filled to capacity it is hoisted to the surface with it load of cored rock and excavated rock particles by a heavy-duty electromechanical cable. An expansible contractible and remotely-controlled wheeled-reactive-torque suppressor positioned near the top of the downhole apparatus prevents any reactive-torque-induced rotation of the apparatus and allows the latter to descend downward in an unimpeded manner as the coring operation progresses downward.

2 Claims, 1 Drawing Sheet

METHOD AND APPARATUS FOR CORE-SAMPLING SUBSURFACE ROCK FORMATIONS

BACKGROUND OF THE INVENTION

Figure 1:
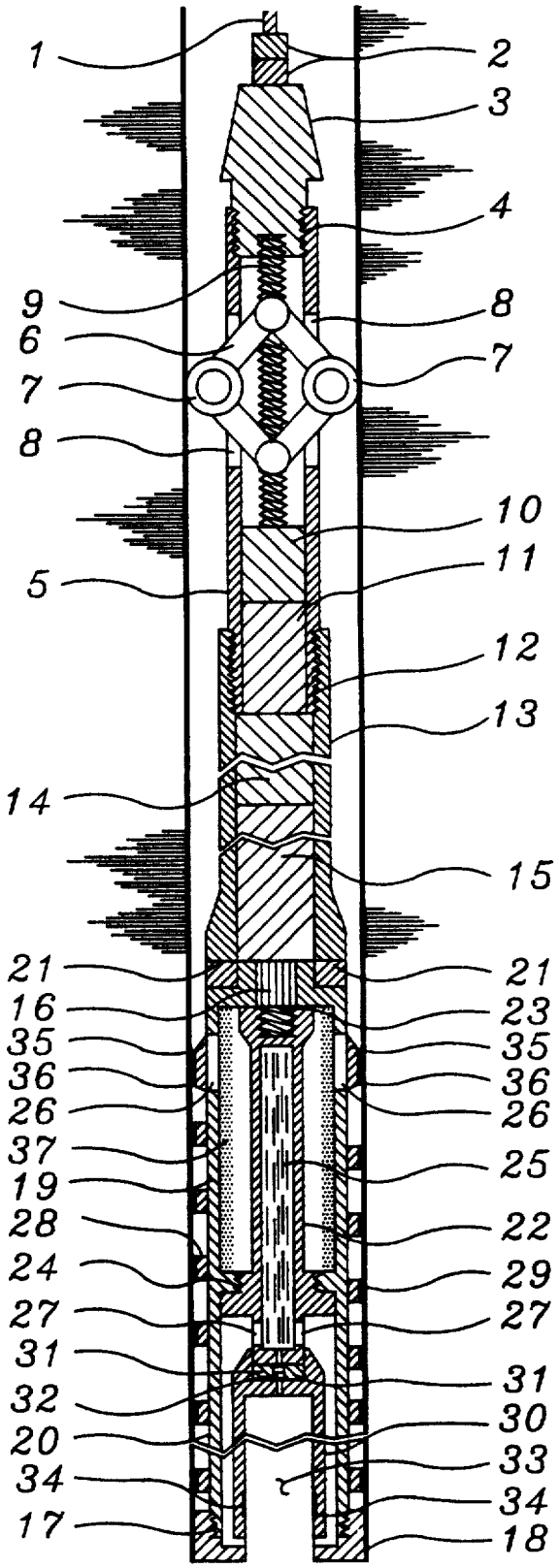

Lightweight narrow-kerf high-speed core-sampling systems such as those employed by the mining industry have a tendency while progressing through rock formations to deviate considerable from the vertical. Consequently, deviation of the corehole trajectory from the vertical often becomes excessive, thus necessitating costly remedial measures directed at reducing the corehole deviation to within acceptable limits.

In my U.S. Pat. No. 4,679,636, *Method and Apparatus for Coring Rock,* is described and illustrated a low-cost lightweight narrow-kerf variable-speed reversible electrically-driven downhole core-sampling system, one variation of which features conveyance of a downhole core-sampling apparatus to and from the bottom of the corehole by means of an electromechanical cable through which is transmitted alternating electric current to downhole electric-power conditioning equipment where alternating current is converted by rectifier means to direct current, voltage and rotational speed are adjusted by transformer means, and direct current is reversed by polarity-switch means so as to power a downhole coresampling apparatus driven by a reversible and variable-speed direct-current electric motor. The method and apparatus described and illustrated in the above patent sought among other functions to solve the dog-leg and corehole deviation problems associated with conventional lightweight narrow-kerf high-speed coring technologies whereas all the threaded connections of the reversible downhole core-sampling apparatus were provided back-out protection by means of a set-screw locking system described in my U.S. Pat. No. 4,548,428, *Anti Back-Out Steel Coupling or Nonmetallic Composite Pipe.*

SUMMARY OF INVENTION

The herein-described and illustrated method and apparatus for core-sampling rock formations features the same method of transmitting electric power to the bottom of the corehole by means of an electromechanical cable and features the same method of electric-power conditioning and the same variable-speed and reversible direct-current-electric-motor drive as that described in my U.S. Pat. No. 4,679,636, and seeks as well to provide back-out protection of all threaded connections by means of the set-screw locking system described in my U.S. Pat. No. 4,548,428. But the herein-described and illustrated method and apparatus for core-sampling rock formations features a heavy-duty electromechanical cable and seeks to solve the dog-leg and corehole deviation problem's associated with conventional lightweight narrow-kerf high-speed coring technologic by means of a combination component rigidly affixed to the exterior of the herein-described downhole core-sampling apparatus which provides high-speed reaming capability, stabilization and external reinforcing or stiffening of the downhole core-sampling apparatus, a means to circulate drilling fluid at the bottom of the corehole and displace upward excavated rock particles, and provide as well additional axial-thrust weight in a manner that lowers the center of gravity of the downhole core-sampling apparatus, thus further improving the stability of the latter. Furthermore, the herein-described and illustrated method and apparatus for core-sampling rock formations is intended for standalone rock-coring operations without the accompanying hole-opening method and apparatus described and illustrated in my U.S. Pat. No. 4,679,636 and without the need for a drilling-fluid circulation pump at the ground surface. But because of the additional axial stress accompanying the standalone rock-coring and corehole-reaming operations the herein-described method and apparatus features the deployment in the core hole of a heavy-duty electromechanical cable. Additional axialthrust weight if required during core-sampling operations, reaming operations, or at any other time is provided by the addition of one or more sinker bars or weight units in the manner described and illustrated in my U.S. Pat. No. 4,679,636. Each sinker bar or weight unit is suitably bored in an axial manner so as to accommodate said heavy-duty electromechanical cable, whereas each sinker bar or weight unit is configured at its terminations so as to accommodate the snap-on coupling described in my U.S. Pat. No. 4,616,855, *Threadless Nonrotating Coupling System.*

It is therefore among the objects of the invention to provide a low-cost lightweight narrow-kerf variable-speed reversible downhole electrically-driven core-sampling method and apparatus intended for core-sampling subsurface rock formations that is powered by and conveyed to and from the bottom of the corehole by means of a heavy-duty electromechanical cable, and which features certain downhole components intended to stabilize and strengthen the downhole core-sampling apparatus, to provide an effective means to ream the corehole wall if required, to provide a viable means to pump drilling fluid with its load of highly-abrasive rock particles at minimal costs, to provide an effective means to separate the excavated rock particles from the lower-density drilling fluid, to provide a means to store the excavated rock particles, to provide a means to deliver chilled drilling fluid to the bottom of-the corehole if required, and to provide an effective means to prevent reactive-torque rotation of the downhole coring apparatus during core-sampling or corehole-reaming operations.

Another object of the invention is to provide a new and improved downhole core-sampling apparatus which is structurally reinforced and stabilized in such a manner that lateral flexing of the downhole apparatus within the corehole is minimized so as to eliminate dog-leg deviations and eliminate excessive deviation from the vertical of the corehole trajectory.

Still another object of the invention is to provide a new and improved downhole core-sampling method and apparatus which utilizes the above-mentioned structural reinforcing and stabilization as a means to displace from the bottom of the corehole drilling fluid with its load of excavated rock particles and to cause the latter to flow upward and around the exterior of the rotating downhole core-sampling apparatus.

Still another object of the invention is to provide a new and improved downhole core-sampling method and apparatus which utilizes the above-mentioned structural reinforcing and stabilization as a means to upstream or downstream constrictions of the corehole wall that might occur from time to time along the length of the corehole.

Still another object of the invention is to provide a new and improved downhole core-sampling method and apparatus which utilizes the above-mentioned structural reinforcing and stabilization as a means to rotate the downhole core-sampling apparatus out of a caved-in corehole if and when unstable geological formations cavein on top of said downhole core-sampling apparatus.

Still another object of the invention is to provide a new and improved downhole core-sampling method and apparatus that is so simple in design, fabrication, and operation that it can be readily and inexpensively repaired and reconditioned in the field without the need for shop repair and shop reconditioning, particularly with regard to the combination component that provides the structural reinforcing, stabilization, reaming, and drilling-fluid-circulation functions.

Still another object of the invention is to provide a new and improved downhole core-sampling method and apparatus that is able to perform the drilling-fluid circulation function and cause the upward displacement of excavated rock particles without the generation of excessive frictional heat and without the need for a viscous, lubricating, or thixotropic drilling fluid.

Still another object of the invention is to provide a new and improved downhole core-sampling method and apparatus that is able to effectively separate the excavated rock particles from the lower-density drilling fluid, effectively concentrate and compact the excavated rock particles in a combination centrifuge/storage-chamber component that is directly integral to the rotating downhole core-sampling apparatus, and effectively store the excavated rock particles in said combination centrifuge/storage-chamber component.

Still another object of the invention is to provide a new and improved downhole core-sampling method and apparatus that is able to utilize when necessary the combination centrifuge/storage-chamber component as a means to deliver to the bottom of the corehole chilled drilling fluid. Under certain unstable geological conditions, as for example, when unconsolidated sand is encountered by the core bit, the combination centrifuge/storage-chamber component is utilized as a means to deliver to the bottom of the corehole chilled brine or some other refrigerant drilling fluid so as to freeze solid indigenous porefluid and consolidate the unconsolidated sands in the manner described in my U.S. Pat. No. 4,825,963 *High-Pressure Waterjet/Abrasive Particle-Jet Coring Method and Apparatus.*

Still another object of the invention is to provide a new and improved downhole core-sampling method and apparatus which is equipped with an expansible and contractible reactive-torque suppressor that is remotely controlled from the ground surface said remotely-controlled reactive-torque suppressor consists of a wheeled scissor-jack assembly which reduces friction in a direction that is parallel to the axis of the corehole but offers resistance to reactive-torque rotation in a plane that is orthogonal to the corehole axis.

The overriding goal of the invention is to provide a new and improved downhole core-sampling method and apparatus for core-sampling subsurface rock formations that reduces downhole excavation costs, improves formation evaluation, and reduces formation damage so as to improve the economics associated with the siting, construction, completion, and operation of water-supply wells, observation wells, purge wells, injection wells, groundwater-source heat-pump wells, mining-exploration coreholes, continental-scientific coreholes, coal-bed methane wells, certain shallow oil and gas wells, or any other borehole-excavation and downhole-sampling operations that require accurate formation evaluation and minimal formation damage of the penetrated section of rock, i.e., without excessive contamination of the core samples or of the penetrated section of rock by drilling-fluid filtrate, drilling-fluid solids, and/or reworked formation solids.

With these and other objects in view, the invention consists in the arrangement and combination of the various components and methods of the invention, whereby the objects contemplated are attained, as hereinafter set forth, in the appended claims and accompanying drawing.

In the drawing:

FIG. 1 is a schematic longitudinal sectional view of the coresampling apparatus.

In an embodiment of the invention for the purpose of illustration, there is shown in FIG. 1 a downhole core-sampling apparatus consisting of heavy-duty electromechanical cable, 1, which is composed of suitable strength members and suitable electric power, command, and sensor circuits. Said heavy-duty electromechanical cable, 1, transmits alternating electric current through its power circuit and is connected by means of a suitable safety joint, 2, to a suitable fishing neck, 3, the latter which is rigidly affixed by means of my snap-on coupling, 4, described in my U.S. Pat. No. 4,616,855, and joined electrically by suitable plug-connection means (not shown) to a suitable cylindrical housing, 5, whereas said heavy-duty electromechanical cable, 1, possesses a tensile strength that exceeds the axial strength of said suitable safety joint, 2. Said suitable cylindrical housing, 5, encloses at least one expansible and contractable wheeled reactive-torque suppressor consisting of a suitable scissor-jack assembly, 6, to which are attached two wheels, both of which are designated, 7. Said scissor-jack assembly, 6, is expanded and contracted through two openings, both of which are designated, 8, in said suitable cylindrical housing, 5, whereas said scissor-jack assembly, 6, is activated by a suitable screw-jack, 9, which in turn is driven by a suitable reversible and variable-speed direct-current electric motor, 10, with or without gear-reduction means. Alternating current for the operation of said expansible and contractible wheeled-reactive-torque suppressor is transmitted from the ground surface through said heavy-duty electromechanical cable, 1, through said suitable safety joint, 2, and through suitable electrical conduit within said suitable fishing neck, 3, through said suitable plug-connection means, and through said suitable cylindrical housing, 5, to a suitable electric power-conditioning unit, 11, where alternating current is transformed and rectified to direct current and where the voltage and polarity of the latter are remotely controlled from the ground surface so as to drive said suitable reversible and variable-speed direct-current electric motor, 10, Said suitable cylindrical housing, 5, is rigidly affixed by threaded means, 12, to a second suitable cylindrical housing, 13, which encloses a second suitable electric power-conditioning unit, 14, where alternating current is also transformed and rectified to direct current and where the voltage and polarity of the latter are also remotely controlled from the ground surface so as to drive a second suitable reversible and variable-speed direct-current electric motor, 15, with of without gear-reduction means. Said second suitable reversible and variable-speed direct-current electric motor, 15, drives by means of a splined drive shaft, 16, a suitable rotating cylinder to which is attached at it lower extremity by threaded means, 17, a suitable core bit, 18. The upper part of said suitable rotating cylinder constitutes the outer rotating cylindrical wall, 19, of a combination centrifuge/storage-chamber component, whereas the lower part of said suitable rotating cylinder constitutes the outer rotating cylindrical wall, 20, of a suitable dual-wall core barrel and said suitable rotating cylinder rides against a suitable thrust bearing, 21, at its upper extremity. Housed concentrically within said outer rotating cylindrical wall, 19, of said combination centrifuge/storage-chamber component is an inner rotating cylinder, 22, rigidly affixed to the drive shaft of said second suitable reversible and variable-speed direct-current electric motor, 15, by threaded means, 23, and rigidly affixed as well to said suitable rotating cylinder by threaded means, 24, Said inner rotating cylinder, 22, which is perforated by a plurality of slotted exit perforations, one of which is designated, 25, constitutes the perforated inner rotating cylindrical wall of said combination centrifuge/storage-chamber component whereas said outer rotating cylindrical wall, 19, of said combination centrifuge/ storage-chamber component is breached by a plurality of inlet poets which are designated, 26. Said inlet ports, 26, are equipped with inlet scoops, which are designated, 35, said inlet scoops, 35, being deployed on the trailing edges of said inlet ports, 26, i.e., with respect to the direction of rotation of said combination centrifuge/storage-chamber component, whereas said inlet scoops, 35, are hardfaced on their outer edges with tungsten carbide or some other suitable hardfacing material, 36. Deployed at the lower extremity of said inner rotating cylinder, 22, of said combination centrifuge/storage-chamber component is a plurality of exit ports, which are designated, 27.

Excavated rock particles, one of which is designated, 37, resulting from the coring operation and separated from the lower density drilling fluid by centrifuge means are stored within said combination centrifuge/storage-chamber component against said outer rotating cylindrical wall, 19.

Rigidly affixed to the exterior of said suitable rotating cylinder from a position just below said inlet ports, 26, near the top of said outer rotating cylindrical wall, 19, of said combination centrifuge/storage-chamber component and extending downward in a right-hand spiral or clockwise manner as viewed from above to just above said suitable core bit, 18, at the lower extremity so of said outer rotating cylindrical wall, 20, of said suitable dual will core barrel is deployed a combination component, 28, hardfaced with tungsten carbide or some other suitable hardfacing material, part of which is designated, 29, said combination component, 28, functioning collectively as a corehole reamer, a stabilizer and external reinforcing of said suitable rotating cylinder, an axialthrust weight, and a drilling-fluid circulation pump and helicaldisplacement elevator of excavated rock particles.

Deployed within said outer rotating cylindrical wall, 20, or rotating outer core barrel, is a suitable nonrotating inner core barrel, 30, which rides against a suitable thrust/swivel bearing, 31, and is vented by a suitable relief valve, 32, whereas the cored rock, 33, is broken and retained within said suitable nonrotating inner core barrel, 30, by means of a suitable core-catcher mechanism, 34.

Having described examples of employing the present invention, I claim:

1. A low-cost light-weight narrow-kerf variable-speed reversible electrically-driven downhole coring apparatus for core-sampling subsurface rock formations comprising:

a heavy-duty electromechanical cable, supported and winched at the ground surface so as to suspend and convey at its distal end said downhole core-sampling apparatus within a corehole in rock, said heavy-duty electromechanical cable also providing electrical conduits through which alternating electric current may be transmitted from the ground surface to said downhole core-sampling apparatus;

a safety joint, or weak link, deployed between the distal end of said heavy-duty electromechanical cable and the top of said downhole core-sampling apparatus, which by virtue of its limited axial strength, will fail, or break, thus separating the distal end of said heavy-duty electromechanical cable from the top of said downhole core-sampling apparatus if and when the latter should become stuck in the corehole and overstress said heavy-duty electromechanical cable to a point that approaches its ultimate strength in tension, or stretching strength;

a fishing neck, or core-shaped latch mechanism, deployed directly below said safety joint, which would allow said downhole core-sampling apparatus, if it should become stuck in the corehole, to be fished, or retrieved, by a tubing-suspended or wire-rope-suspended fishing tool after said heavy-duty electromechanical cable has separated from said downhole coresampling apparatus at said safety joint;

a cylindrical housing, deployed directly below and threaded onto said fishing neck, which partially envelopes and supports at least one remotely-controlled wheeled reactive-torque suppressor that is expanded against or contracted from the corehole wall by means of a screw-jack/scissor-jack assembly; said cylindrical housing envelopes and supports, as well, all power, command, and sensor circuits, electrical-power conditioning unit, and a reversible and variable-speed DC electric motor which activates said screw-jack/scissor-jack assembly; sensor circuits are made a part of the herein-described apparatus so as to make possible the incorporation into said apparatus, if so required, downhole sensors for remotely monitoring from the ground surface certain downhole operating parameters, as for example, the temperature of the drilling fluid, the angle of drift of said apparatus from the vertical, the aximuth of any such deviation from the vertical, the change in orientation of the wheelled reactive torque suppressor, the amount of pressure applied by the latter against the corehole wall, and/or the amount of axial thrust weight applied during coring or reaming operations;

a second cylindrical housing, deployed directly below and threaded onto said cylindrical housing, which envelopes and supports a second electric-power conditioning unit, a second reversible and variable-speed DC electric motor, and the power, command, and sensor circuits required to operate the components enveloped and supported by said second cylindrical housing;

a rotating cylinder, deployed directly below said second cylindrical housing, which is driven by said second reversible and variable-speed DC electric motor and to which is attached a thrust bearing at its upper extremity and to which is attached a core bit at its lower extremity;

a dual-wall core barrel which constitutes the lower part of said rotating cylinder, said dual-wall core barrel equipped with a thrust/swivel bearing and a relief valve atop its nonrotating inner core barrel, and equipped, as well, with a core-catcher mechanism near the lower extremity of its nonrotating inner core barrel;

a combination centrifuge/storage-chamber component which constitutes the upper part of said rotating cylinder, driven, as well, by said second reversible and variable-speed DC electric motor, and driven integrally and simultaneously with said rotating cylinder; said combination centrifuge/storage-chamber component is equipped with a plurality of scoopassisted inlet ports deployed on its exterior wall near its upper extremity, whereas a plurality of slotted exit perforations is deployed throughout the length of its interior wall and a plurality of exit ports is deployed at its lower extremity just above said nonrotating inner core barre;

a combination component rigidly affixed in a spiral manner to the exterior of said rotating cylinder and hardfaced on its exterior edges by hardfacing material; said combination component functioning collectively as a spiral corehole reamer, a spiral stabilizer, and external reinforcing of said rotating cylinder, a spiralaxial-thrust weight, a spiral drilling-fluid circulation pump or Archimedes' screw pump, and an auger-like helical inertial-displacement elevator of excavated rock particles.

2. A downhole coring method for core-sampling rock formations using a low-cost lightweight narrow-kerf variable-speed reversible electrically-driven coring apparatus comprising the steps of:

conveyance at the ground surface of the downhole core-sampling apparatus by means of a winch and cable-conveyance system and conveyance of said apparatus from the ground surface to the bottom of a corehole in rock by means of a heavy-duty electromechanical cable;

providing a source of AC electric power and transmitting same through said heavy-duty electromechanical cable from the ground surface to the down-hole core-sampling apparatus;

converting AC electric power by downhole electric-power performing means to DC electric power so as to energize and expand the reversible and variable-speed DC electric-motor-driven screw-jack screw-jack wheeled reactive-torque suppressor and force the wheels of the rear against the core rock wall in a manner that prevents reactive-torque rotation of the downhole core-sampling apparatus;

converting AC electric power by downhole electric-power-conditioning means to DC electric power so as to energize the reversible and variable-speed DC electric motor drive which among other functions cause the rotating cylinder and the attached core bit to rotate to the right or in a clockwise manner as viewed from above;

increasing or decreasing the applied voltage so as to cause a corresponding increase or decrease in the rotational speed, as so desired, of the downhole core-sampling apparatus;

operating a drum brake at the ground surface so as to increase or decrease the tension of said heavy-duty electromechanical cable and to therefore increase or decrease, as so desired, the axial thrust weight placed upon said core bit, and to operate said drum brake in a manner that unspools said heavy-duty electromechanical cable and allows the downhole coresampling apparatus to descend downward through the rock as so desired;

causing the drilling fluid at the bottom of the corehole to circulate by rotating to the right or clockwise as viewed from above the rotating cylinder, the attached core bit, and the attached combination component, causing said drilling fluid to displace upward and exterior to said rotating cylinder by the rotating action and spiral shape of the combination component, said displacement of drilling fluid, or pumping action, caused by Archimedes' screw-pump effects;

causing excavated rock particles not transported upward by the upward-flowing drilling fluid to be transported upward by means of inertial-displacement effects created by the rotating action and helical or screw shape of the auger-lie combination component;

causing the upward-flowing drilling fluid and upward-displaced rock particles to flow along a decreasing pressure gradient created by the circulating drilling fluid, and thence enter the scoop-assisted inletports of the combination centrifuge/storage-chamber component;

causing the circulating drilling fluid and excavated rock particles to enter the top of the rotating centrifuge/storage-chamber component so as to cause the excavated rock particles to separate by centrifuge effects from the lower-density drilling fluid and to cause the excavated rock particles to concentrate and compact against the outer rotating cylindrical wall of the combination centrifuge/storage-chamber component;

causing the clarified drilling fluid to circulate downward and inward along said decreasing pressure gradient so as to enter the slotted perforations of the inner rotating cylinder and flow downward through the center of the latter and to exit the combination centrifuge/storage chamber component through the exit ports just above the nonrotating inner core barrel;

causing the clarified drilling fluid to flow downward along said decreasing pressure gradient through the annular space between the nonrotating inner core barrel and the outer rotating cylindrical wall, or rotating outer core barrel, to the bottom of the corehole, thus completing the drilling-fluid circulation loop;

causing the downhole core-sampling apparatus to descent through the rock with minimal flexing of its rotating components and minimal dog-leg deviations and minimal deviations of the corehole trajectory from the vertical, such verticality enhancement resulting from the stabilizing effects, spiral-reinforcing effects, and the lower center of gravity created by the spiral-shaped combination component;

causing the downhole core-sampling apparatus to continue to descend through the rock until the nonrotating inner core barrel is filled to capacity with cored rock and the combination centrifuge/storage component is filled to capacity with excavated rock particles from the circular core kerf;

hoisting the downhole core-sampling apparatus along with its load of cored rock and excavated rock particles to the ground surface by means of the heavy-duty electromechanical cable, retrieving at the ground surface the sample of cored rock and excavated rock particles, and repeating the method until the downhole core-sampling operation is completed;

expanding the wheeled reactive-torque suppressor against the corehole wall when conveying the downhole core-sampling apparatus to and from the bottom of the corehole so as to prevent the rotation or twisting of the heavy-duty electromechanical cable;

dissipating as the ground surface by resistant-heating means or some other electrical-power dissipation means electric power generated by the electric-motor drive of the downhole core-sampling apparatus if and when said electric-motor drive inadvertently functions as an electric generator during the conveyance of said downhole core-sampling apparatus through drilling fluid to and from the bottom of the corehole;

reaming the corehole if and when it is necessary during core-sampling operations so as to eliminate constrictions within the corehole and allow the unobstructed passage of the downhole core-sampling apparatus to and from the bottom of the corehole, said corehole-reaming operations made possible by the rotation or counterrotation of the spiral-shaped combination component, operating in either the down-reaming mode or the up-reaming mode, and said corehole-reaming operation made possible, as well, by the wheeled reactive-torque suppressor;

cooling the corehole if and when it is necessary during core-sampling operations so as to allow the electrically-driven core-sampling apparatus to operate efficiently, said corehole-cooling operations accomplished by the conveyance of cooled drilling fluid to the bottom of the corehole by means of the combinations centrifuge/storage-chamber component;

stabilizing the corehole wall and the cored sample of rock if and when it sis necessary during core-sampling operations in loose or unstable formations so as to allow maximum recovery of the cored samples or rock and to minimize sloughing or cave-ins of the corehole wall, said stabilization operations accomplished by the conveyance of chilled brine or some other refrigerant drilling fluid to the bottom of the corehole by means of the combination centrifuge/storage-chamber component, said chilled brine or other refrigerant drilling fluid retained within the combination centrifuge/storage-chamber component, if so required, on its journey to the bottom of the corehole by expanding the wheeled-reactive-torque suppressor against the corehole wall and rotating the downhole core-sampling apparatus either in a clockwise or counter-clockwise manner so as to create the necessary pressure gradient and thus prevent the loss of the drilling fluid on its downward journey to the bottom of the corehole where ultimately said chilled brine or other refrigerant drilling fluid freezes solid the formation porefluids thereby freeze-stabilizing the corehole wall and freeze-encapsulating the core sample of rock;

rotating the downhole core-sampling apparatus in a left-hand or counter-clockwise manner as viewed from above if and when it is necessary so as to back-auger said down core-sampling apparatus out of a caved-in corehole, said reverse-augering operation made possible by the reversible DC electric-motor drive, the spiral-shaped combination component, and the wheeled reactive-torque suppressor;

rotating the downhole core-sampling apparatus in a left-hand or counter-clockwise manner so as to straighten said heavy-duty electromechanical cable by reactive-torque means if and when said cable should become twisted at any time;

alternating a right-hand or clockwise-rotating and right-hand spiral core-sampling apparatus with a left-hand or counterclockwise-rotating and left-hand spiraled downhole core-sampling apparatus if and when it is necessary so as to minimize reactive-torque-induced corehole deviation, i.e., the left-hand corkscrew-trajectory effects that otherwise might result if just a right-hand or clockwise-rotating and right-hand-spiraled core-sampling apparatus were deployed in the corehole;

substituting if and when it is necessary to do so, i.e., when cored-rock samples are not required or when downhole conditions prevent the recovery of cored rock, a sinker bar or weight unit in place of the nonrotating inner core barrel, said sinker bar or weight unit centralized within the outer rotating cylindrical wall or rotating outer core barrel by centralizing fins so as to allow the passage of the downflowing drilling fluid, and substituting, as well, a drilling bit in place of the core bit so as to advance the downhole core-sampling apparatus downward through the rock in a drilling mode rather than in a coring mode;

providing if and when it is necessary additional downward axial thrust to the downhole core-sampling apparatus during core-sampling, down-reaming, or drilling operations, and providing additional upward axial thrust to said apparatus during core-breaking or corehole up-reaming operations or when said apparatus is stuck in the corehole, said additional axial thrust provided by the deployment on the wheeled-reactive-torque suppressor of traction wheels and the activation of the latter by means of a remotely-controlled downhole reversible DC electric-motor drive.

* * * * *